US008813982B2

(12) United States Patent
Van Geel et al.

(10) Patent No.: US 8,813,982 B2
(45) Date of Patent: Aug. 26, 2014

(54) CAP FOR A CONTAINER

(75) Inventors: Filip Dominique Hubert Van Geel, Vilvoorde (BE); Katrien De Malsche, Hamme (BE); Rainer Scharrenberg, Kronberg (DE); Gene Michael Altonen, West Chester, OH (US); Guy Hubert Stephane Sylvain Culeron, St. Genesius Rode (BE); Neil Anthony Litten, Sonnning (GB); Georgina Lindsey Clare, High Wycombe (GB)

(73) Assignee: The Procter & Gamble Company, Cincinnati, OH (US)

( * ) Notice: Subject to any disclaimer, the term of this patent is extended or adjusted under 35 U.S.C. 154(b) by 90 days.

(21) Appl. No.: 13/247,336

(22) Filed: Sep. 28, 2011

(65) Prior Publication Data

US 2013/0075404 A1 Mar. 28, 2013

(51) Int. Cl.
*B65D 43/16* (2006.01)
*B65D 43/22* (2006.01)

(52) U.S. Cl.
USPC ..... 215/245; 215/237; 222/556; 220/254.3; 220/326

(58) Field of Classification Search
USPC ..... 215/232, 235, 237, 244, 245; 222/556; 220/258.2, 326, 254.3
See application file for complete search history.

(56) References Cited

U.S. PATENT DOCUMENTS

| | | | | |
|---|---|---|---|---|
| 4,500,008 | A * | 2/1985 | Cook | 220/242 |
| 4,948,003 | A * | 8/1990 | Munoz | 215/237 |
| 5,121,845 | A * | 6/1992 | Blanchard | 215/232 |
| 5,547,091 | A | 8/1996 | Neveras et al. | |
| 5,996,859 | A | 12/1999 | Beck | |
| 6,409,034 | B2 | 6/2002 | Schorner | |
| 6,575,323 | B1 * | 6/2003 | Martin et al. | 220/254.3 |
| 6,761,279 | B1 * | 7/2004 | Martin et al. | 220/258.2 |
| 7,404,495 | B2 | 7/2008 | Keung | |
| 2007/0151993 | A1 * | 7/2007 | Yelland | 222/546 |
| 2008/0237236 | A1 | 10/2008 | Tanner et al. | |
| 2010/0276460 | A1 | 11/2010 | Domoy et al. | |
| 2013/0075404 | A1 | 3/2013 | Van Geel et al. | |
| 2013/0075414 | A1 | 3/2013 | Van Geel et al. | |

FOREIGN PATENT DOCUMENTS

| | | | |
|---|---|---|---|
| DE | 101 603 62 | A1 | 6/2003 |
| EP | 2 218 654 | A1 | 8/2010 |
| FR | 2 888 567 | A1 | 1/2007 |
| WO | WO 2006/003168 | A1 | 1/2006 |
| WO | WO 2006/102601 | A1 | 9/2006 |
| WO | WO 2009/071298 | A1 | 6/2009 |

OTHER PUBLICATIONS

International Search Report for International Appln. Serial No. PCT/US2011/053801, mailed Nov. 16, 2011, 9 pages.
Non-Final Office Action for U.S. Appl. No. 13/247,300, mailed Nov. 20, 2012, 20 pages.
Final Office Action for U.S. Appl. No. 13/247,300, mailed Mar. 19, 2013, 12 pages.

* cited by examiner

*Primary Examiner* — Fenn Mathew
*Assistant Examiner* — James N Smalley
(74) *Attorney, Agent, or Firm* — Gary J. Foose

(57) ABSTRACT

A cap resistant to impact forces and providing a leak-tight fitting to a container while allowing simple and quick release.

11 Claims, 5 Drawing Sheets

CAP FOR A CONTAINER

FIELD OF INVENTION

The present invention relates to a novel cap particularly resistant to impact forces to provide a leak-tight fitting to a container whilst allowing simple and quick release. A preferred field of use is that of caps for large containers for domestic or household use, containing detergents or other cleaning preparations, fabric conditioners and the like. However, it is understood that said cap may equally be suitable in other fields of use such as containers for manual and automatic dishwashing liquids, hair-care products and oral care applications such as mouth washes.

BACKGROUND OF THE INVENTION

It may be desirable to provide a cap with effective tight locking and sealing to prevent undesired leakage from containers throughout all stages of the supply chain, from transportation of said containers all the way through everyday usage and accidental knock-over. It is particularly desirable to achieve the abovementioned advantages while still providing quick and effortless opening and closing of said cap.

Various solutions exist for container caps suitable for use with containers holding fluid base substances such as, shower gels, hair shampoos, suncreams, sun lotions, body oils and the like. The purpose of these caps is, on the one hand, to form a leakproof seal so that the substance contained within does not escape and so that outside air does not constantly pervade the container. On the other hand, such cap should be easy to open and close.

Caps of this kind usually have an essentially tubular-shaped cap body with a female thread provided in its inner wall for screwing onto, for example, an accordingly configured (male) thread at the upper end of a container neck. By means of a sealing arrangement, a leakproof connection is created between the cap and the container.

An example of such caps is U.S. Pat. No. 6,409,034B. U.S. Pat. No. 6,409,034B relates to a hinged cap body designed for fitting with a leakproof seal on a container opening, a hinged lid joined to the cap body for closing an outlet aperture formed on the cap body, and a locking arrangement formed on the cap body and the hinged lid. Sealing is achieved via a protrusion extending from said hinged lid which at least partly lodges in the outlet aperture when the lid is closed. Ease of opening and closing is achieved via a combination of; an elastically deformable material, which creates a biasing force between the cap body and the hinged lid in order to bring the hinged lid into an open position; and a locking projection which, in closed position, clutches rearwards to a biased, manually operable locking element which is disposed on the cap body. The locking arrangement is especially simple to use in that only a light pressure must be manually applied to disengage the locking element from the locking projection and allow the elastically deformable material to flip the hinged lid open.

Such device introduces a number of disadvantages. One disadvantage is that the hinged lid may easily flip open if the container is accidentally knocked over by the user and cause spillage of the content. Another disadvantage is that the only sealing means for preventing the content to exit the outlet aperture is the protrusion on the hinged lid which may leak when subjected to high pressures caused by, for example, high impact forces during transportation. Further disadvantages may be: alignment problems between the protrusion and the outlet aperture in case of distortion of the hinges and/or its suitability only for small outlets.

Other caps exist providing various locking mechanisms, particularly for child-proof containers of medications. Caps of this kind use mechanisms such as the "push-and-turn" system or other mechanisms such as those described in WO2006/102601A1 and U.S. Pat. No. 7,404,495B2, which require the combination of a radial force and an upward force applied onto a portion of said locking mechanism to open said cap. Although these mechanisms may be useful in preventing a child from opening the caps, they render singlehanded operation difficult, which may be important for certain users, such as for elderly.

Further caps exist providing a moisture resistant closure such as those described in EP2218654A1. EP2218654A1 relates to a cap comprising a base portion with an outer periphery adapted to extend over at least a portion of a container, a skirt depending downwardly from the base portion and a lip seal member depending downwardly from the base portion. The container has an opening bounded by a lip extending upwards from the container. The lip seal member is adapted to abut an interior side of the lip, when the cap is in closed position.

Such devices, although suitable for preventing moisture entering or exiting the container, do not provide a strong enough locking force to prevent the lid from opening upon impact. Furthermore, such devices rely solely on a single sealing surface thus more likely to leak during, for example; handling of the container by the user wherein the container is subjected to a given, albeit small, holding pressure; or accidental knock-over.

Thus, it is an object of the present invention to overcome the abovementioned problems whilst providing a simple, cost-effective, efficient in use and compact solution.

In one aspect of the present invention, it is an object to provide a cap that tightly locks and seals a container to prevent undesired leakage throughout all stages of the supply chain, while providing quick and effortless opening and closing of said cap.

In another aspect of the present invention, it is an object to provide a cap resistant to deflections, particularly deflections arising from tightening of said cap onto the neck of a container, to ensure even more effective leak-tight sealing.

In another aspect of the present invention, it is an object to provide a locking means for a cap which allows tight locking against impact while being quick and easy to open, particularly single-handedly.

Other objects, features and advantages of the invention will be better understood with reference to the attached drawings and the specification hereinafter.

SUMMARY OF THE INVENTION

In one aspect, the present invention relates to a cap comprising: a cap body capable of being connected to a container, said cap body comprising an outlet opening therein. A lid for coupling with said cap body. A disposable sealing means sealing said outlet opening, and further a locking means disposed on said cap body and said lid to lock said lid onto said cap body.

DETAILED DESCRIPTION OF THE INVENTION

Figure 1A:
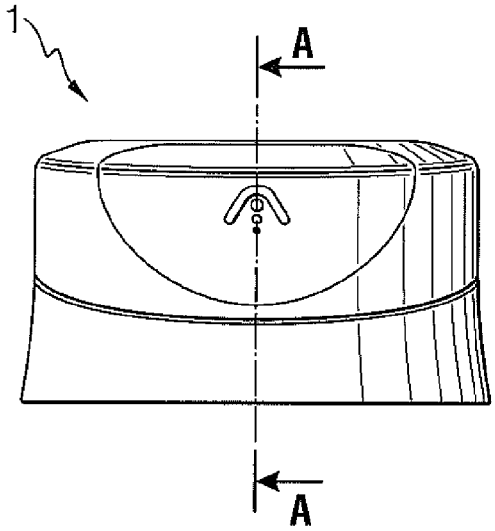
FIG. 1A is a front view of the cap according to one embodiment of the present invention.
Figure 1B:
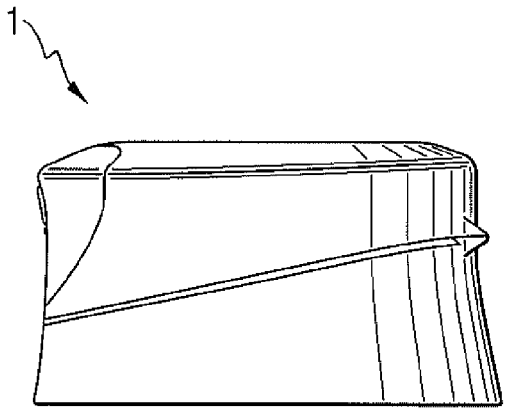
FIG. 1B is a side view of the cap according to one embodiment of the present invention.

By the terms "a" and "an" when describing a particular element, we herein mean "at least one" of that particular element.

The term "lock or locking" as used herein means that the cap is tightly secured in its closed position. By the term "tightly secured" as used hereinbefore it is meant that said cap withstands a force of at least 30N, preferably at least 50N, and more preferably at least 70N.

The term "large container" as used herein means containers for holding at least 1.5 liters, preferably at least 2 liters of a liquid, more preferably from 2 liters to 5 liters, most preferably from 2 liters to 3 liters.

The term "pressure in the radial direction" or "radial pressure" as used herein means a pressure in a direction substantially perpendicular to the longitudinal axis (YY).

The invention is directed to a cap (1) particularly suitable for large containers, and particularly holding a liquid. The containers may be of any shape and size and made of any material; resilient, flexible, rigid or otherwise. Suitable materials include but are not limited to plastic and glass.

The following sections will illustrate in detail the essential features and preferred embodiments of the present invention.

Cap

The cap (1) according to the present invention comprises a cap body (2) capable of being connected to a container and a lid (3) for coupling with said cap body (2). Said cap (1) further comprises a disposable sealing means (4) sealing an outlet opening (5) located on said cap body (2), and a locking means disposed on said cap body (2) and said lid (3) to lock said lid (3) onto said cap body (2).

At least a portion of the cap (1) may be formed of a plastic material, by injection molding or other suitable molding techniques. For example, the cap (1) may be molded of polypropylene. Preferably the cap (1) will have a Tensile modulus of at least 1500 MPa, preferably between 1600 and 1700 MPa. In one embodiment, the said at least one portion of the cap (1) can be formed as a single unit. Alternatively, said at least one portion of the cap (1) may be molded independently and then subsequently assembled.

Cap Body

The cap (1) of the present invention may comprise a cap body (2) having a longitudinal axis (YY) extending parallel to the centerline thereof. Said cap body (2) may comprise an outlet opening (5) therein, preferably said cap body (2) comprises a spout (6) with said outlet opening (5) being located therein.

Figure 2:
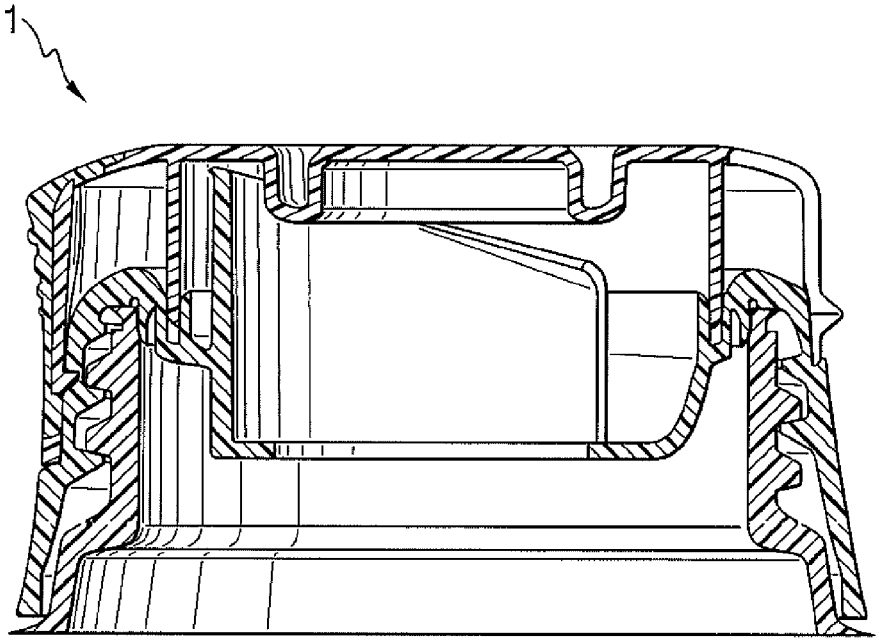
FIG. 2 is a cross-section taken along the line A-A of FIG. 1A of the cap according to one embodiment of the present invention.
Figure 3:
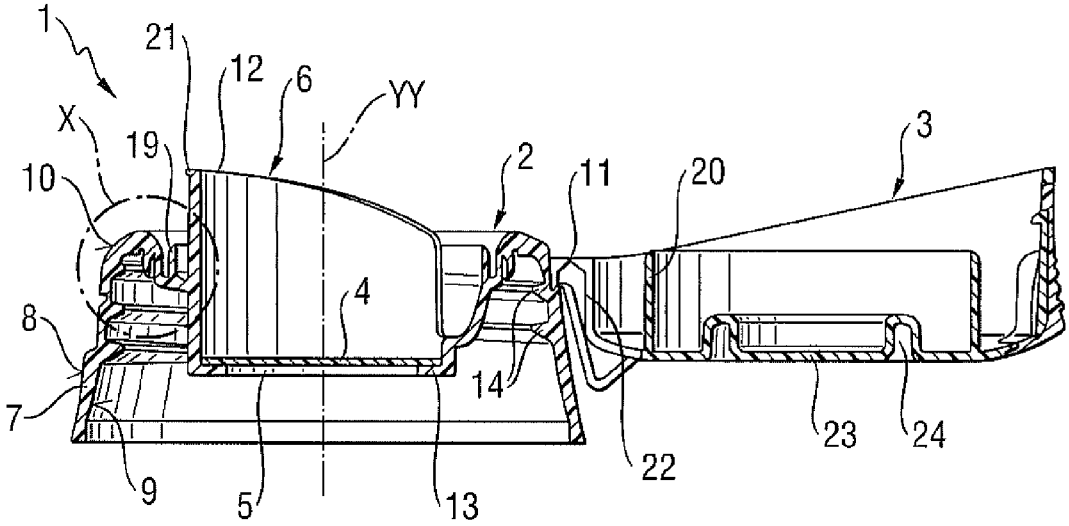
FIG. 3 is the cross-section of FIG. 2 with the lid in its open position.

Referring to FIG. 2 and FIG. 3, said cap body (2) may comprise an outer wall (7) defining the shape of said cap body (2). Preferably, the average thickness of said outer wall (7) is typically between 2.0 mm and 2.5 mm. Said outer wall (7) may be defined by an outer surface (8) and an inner surface (9). Said cap body (2) may further comprise a first surface of contact (10) located on said outer surface (8) and may subtend from a portion substantially proximal to the apex of said outer surface (8) of said outer wall (7). Said first surface of contact (10) is preferably non-linear such that when at least a portion of the locking means, preferably a portion of a panel thereof, abuts said first surface of contact (10), a sliding motion is encouraged. Preferably said first surface of contact is curved with the greatest gradient being located proximal to the apex of said outer wall (7). If the cap comprises a hingedly connected lid, said first surface of contact is preferably located opposite the hinge (11).

In one embodiment said spout (6) may extend from a first portion, defining a top (12), vertically displaced from said outer wall (7), to a second portion, defining a base (13). Said base (13) may comprise said opening therein (5). Preferably, said base (13) may be capable of entering in at least a portion of the container to which said cap (1) is connected to. Said spout (6) may be constructed to have a substantially flat top (12). Alternatively, said top (12) may be slanted at an angle and present a curvature on its uppermost surface. It may be particularly desirable for the distance between the uppermost portion of the top (12) of the spout (6) and the apex of said outer wall (7) to be at least 6 mm preferably at least 7 mm, more preferably between 7 and 10 mm. It is understood that said distance between the uppermost portion of the top (12) of the spout and the apex of said outer wall (7), and thus the total height of the spout (6), may also be determined by the height of said lid (3). This embodiment is particularly advantageous for allowing pouring of a liquid content to be achieved in a predetermined direction without dripping onto the outer wall (7) and/or container. Introducing a spout (6) having a sufficient height such that the distance between the uppermost portion of said top (12) and the apex of said outer wall (7) satisfies the abovementioned range significantly affects the total height of the cap (1). Indeed, there may be instances where it is desirable to keep the total height of said cap (1) as low as possible, for example, due to shelf space restrictions whereby in order to have the largest possible container, the cap (1) height needs to be constrained. In these particular scenarios it may become particularly important to further minimize any upward deflections of the cap body (2) that may arise during tightening of the cap (1) onto the container to prevent the spout (6) from pushing onto a portion of the cap lid (3).

The cap body (2) may further comprise a female thread (14) extending from said inner surface (9) for coupling with a container neck threaded accordingly, to secure said cap body (2) onto said container.

Figure 4:
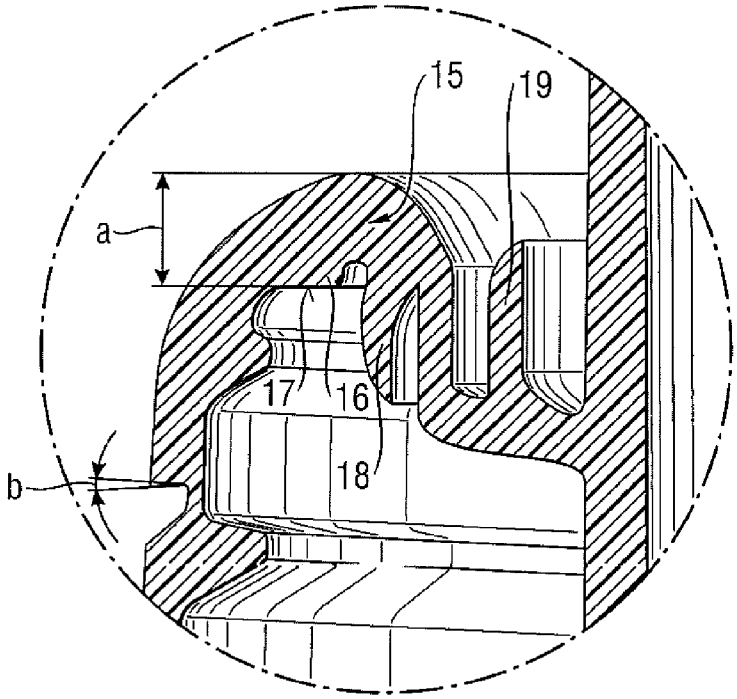
FIG. 4 is a blow-up of portion X of FIG. 2 of the cap according to one embodiment of the present invention.

Referring to FIG. 4, said cap body (2) may comprise a bridge-type portion (15) formed by a portion of the outer wall (7), preferably said portion of the outer wall (7) is the uppermost portion thereof. In this embodiment, said bridge-type portion (15) comprises a flat notch (16) capable of contacting the uppermost surface of a container neck when said cap body (2) is fully screwed onto said container neck. Preferably, said flat notch (16) is oriented so that the flat surface (17) thereof makes contact with said uppermost surface of the container when said cap body (2) is fully screwed on. In this embodiment, the distance "a" between the apex of said bridge-type portion (15) and said flat surface (17) is between 2 mm and 3 mm, preferably between 2.2 mm and 2.5 mm. This specific notch configuration and range of thickness has been found to be particularly beneficial to reduce the stress concentrations generated upon tightening of the cap body (2) onto the container neck and to contribute in stiffening the bridge-type portion region against deflection at high torque.

In a preferred embodiment, said cap body (2) may comprise a plug seal (18) proximal said flat notch (16) extending substantially parallel to the longitudinal axis (YY) of said cap body (2). The plug seal (18) may be capable of contacting at least a portion of the inner surface of a container neck, when said cap body (2) is coupled to said container.

In a preferred embodiment, said flat notch (16) and plug seal (18) may provide a sealing means when the cap body (2) is screwed tightly onto a container neck by blocking any passages which may be formed in the connecting portion between said cap body (2) and said container neck and preventing any content from escaping through said passages.

In a further embodiment, said bridge-type portion (15) may be generally curvilinear, preferably said bridge-type portion (15) may present a curvature having a radius of between 4.5 mm and 5.5 mm, preferably 5.0 mm. This configuration has been found to reduce the stress concentrations to which the bridge-type portion is subjected to when said cap body (2) is tightly screwed onto a container neck.

Such stiffening, resistance to deflection and shape may become particularly important when tightening or over-tightening of the cap body (2) occurs. Strong tightening of the cap body (2) onto a container neck may be required in order to maximize the sealing capabilities of said cap body (2) and to prevent accidental unscrewing from said container neck. It may also be desirable to tighten the cap body (2) to such an extent to prevent the user to easily unscrew it, particularly when the cap comprises a separate lid that the user should open instead. In these scenarios it is desirable to screw said cap body (2) with a torque of up to 600 Ncm, preferably from 240 Ncm to 600 Ncm. A problem which is likely to arise at such high torque values is deflection of the regions subjected to the greatest force. Such deflection may cause other components such as the spout (6) do deflect upwardly and push onto the lid making it easier for the cap to open and leak. It is therefore particularly desirable for the cap body (2) of the present invention to be capable of being connected to a container neck with a torque of up to 400 Ncm, preferably up to 500 Ncm, more preferably up to 600 Ncm, most preferably from 240 Ncm to 600 Ncm, without experiencing a deformation of more than 0.3 mm. The aforementioned embodiments have been found particularly effective in withstanding a torque of up to 400 Ncm, preferably 100 Ncm to 400 Ncm, more preferably 100 Ncm to 500 Ncm, most preferably 240 Ncm to 600 Ncm, and wherein the deflection is less than 0.3 mm.

In an alternative embodiment (not shown) at least a portion of the bridge-type portion (15) may be coated with a material capable of elastically deforming upon the application of a force. Preferably said material is selected from polyolefines. Alternatively an O-ring may be introduced. The coating may be of a different material than that of the cap body (2), preferably said coating is of a material that experiences a greater elastic deformation compared to the material of said cap body (2). In this embodiment the portion of the bridge-type portion (15) being coated provides for a stiff structure while the material in the coating purposively deforms to provide a leak-tight seal even at lower torques.

In a preferred embodiment the cap body (2) may further comprise a flange (19) extending substantially parallel and proximal to the spout (6). Said flange (19) may be located substantially parallel and in between a portion of the inner surface (9) of the outer wall (7) and a surface of said spout (6). In this embodiment a gap is formed between said flange and said portion of the inner surface (9) to accommodate the insertion of a ridge (20) extending from a surface of the lid (3) when said lid (3) is closed.

Figure 5:
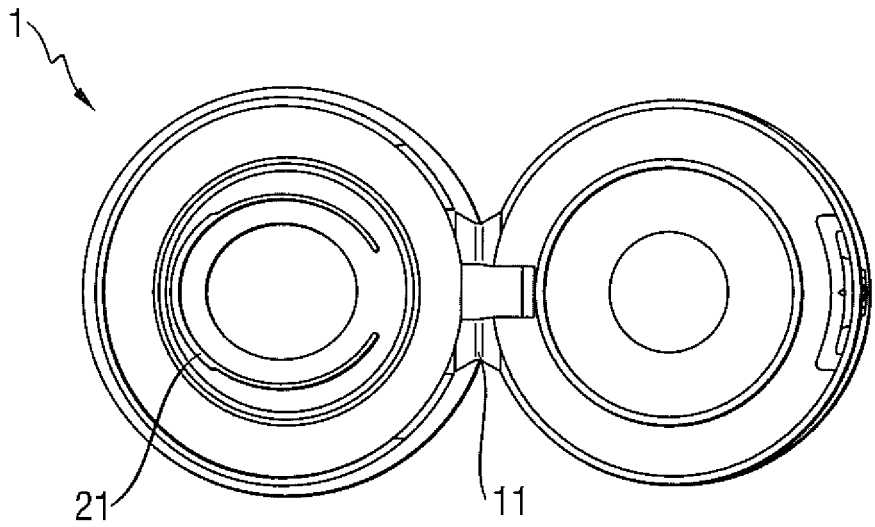
FIG. 5 is a top view of the cap according to one embodiment of the present invention in its open position.

Referring to FIG. 5, the spout may be of any shape such that the liquid content inside a container can be easily poured. Preferably, said spout (6) has a horse-shoe-type perimeter at the top to ease pouring in a predetermined direction. If the cap (1) has a lid (3) hingedly connected to said cap body (2), said predetermined direction is oriented such that it points way and opposite the hinge (11). In an even more preferred embodiment said spout (6) comprises a product flow cut off lip (21) located proximal to the uppermost portion of the top (12) of said spout (6). Said product flow cut off lip (21) has the advantage of reducing dripping onto portions of the cap body ( ) which may in turn affect the smooth opening and closing of the cap (1).

Lid

The cap (1) of the present invention comprises a lid (3). Said lid may comprise a first lid surface (22) defining the outside shape and perimeter of said lid (3).

In a preferred embodiment said lid (3) may comprise a ridge (20) extending within and substantially parallel to said first lid surface (22) which is capable of inserting in between a flange (19) and a portion of the inner surface (9) of the outer wall (7) of the cap body (2) when said lid (3) is closed. This configuration is particularly advantageous in providing an additional sealing means when said lid (3) is locked onto said cap body (2).

In a preferred embodiment said lid (3) may be hingedly connected to the cap body (2) with one or more hinges (11). This configuration aids single-handed opening of the cap (1) since, once unlocked, the lid (3) simply pivots to the open position with pressure applied by the user. Alternatively the hinge may comprise a spring element that forces the lid (3) to open upon unlocking. Suitable spring elements may include any elastic object that stores mechanical energy, such as springs, including but not limited to cantilever springs, coil springs, helical springs, torsion springs, and/or elastically deformable materials such as thermoplastic elastomers (TPE). Preferably the one or more hinges (11) are one part with said lid (3) and said cap body (2) and are made of the same material. It is however understood that other types of hinges may equally be suitable such as flush type hinges, butterfly hinges, butt hinges and the like which are welded or similarly joined to said lid (3) and said cap body (2).

Figure 6:
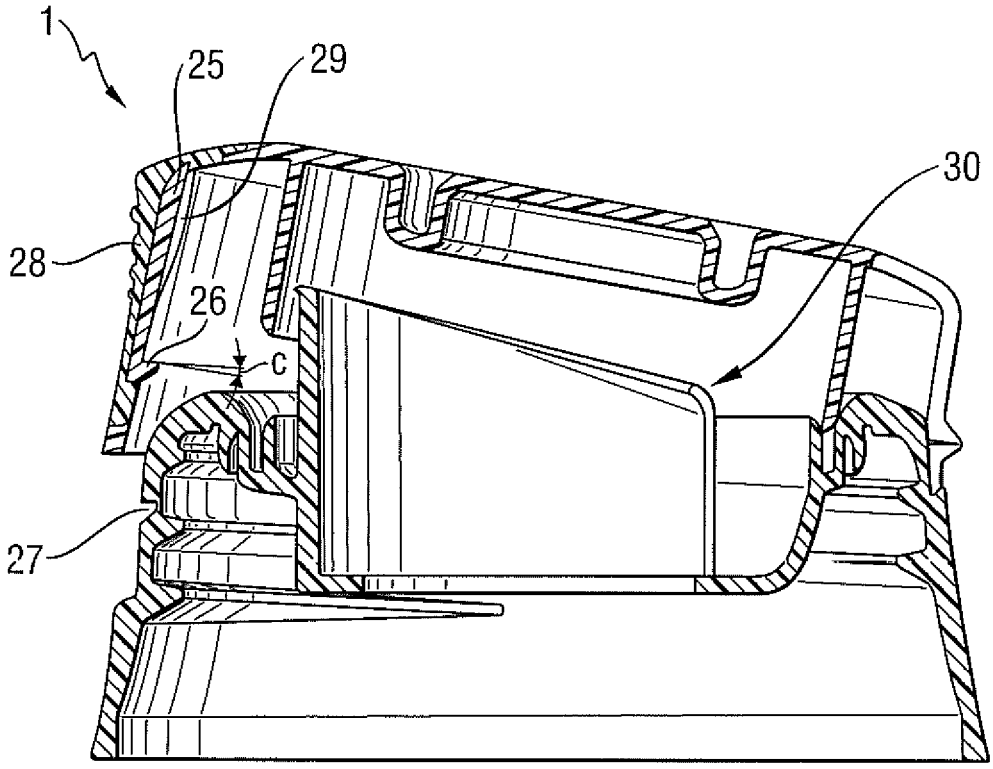
FIG. 6 is a side cross-section view of the cap according to one embodiment of the present invention with the lid in its semi-closed state.
Figure 7:
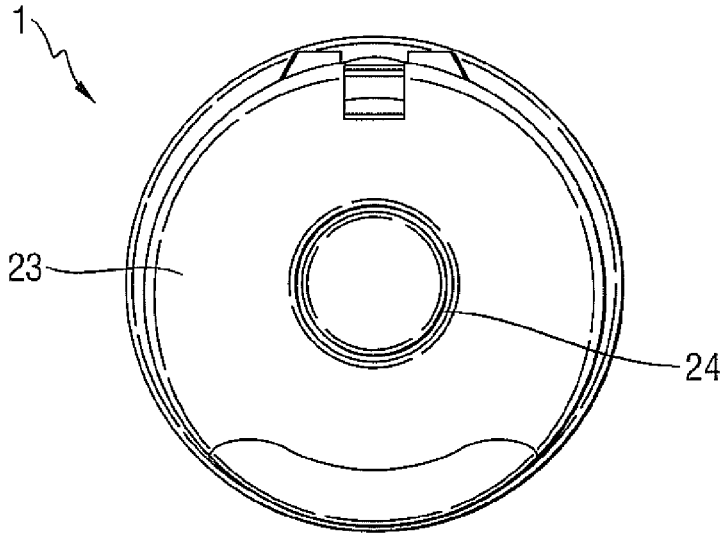
FIG. 7 is a top view of the cap according to one embodiment of the present invention in its closed position.

Referring to FIG. 6 and FIG. 7, the lid (3) may comprise a top surface (23) defining the uppermost outer surface of said lid (3). Said top surface (23) may comprise an inner top face facing the inside of the container when said lid (3) is closed onto the cap body (2). In a preferred embodiment said top surface (23) comprises an interconnected groove (24). By "interconnected" it is herein meant that the groove (24) forms a closed shape, thus the groove (24) does not have a beginning nor an end. Preferably, said shape is circular. It is however, understood that other shapes may equally be suitable such as oval, square, rectangular, triangular and so on. In this embodiment, such groove (24) allows for attachment of a doser onto the top of said lid (3).

The lid (3) may be made of the same material as the cap body. Preferably said material is selected from polyolefines and more specifically polypropylene.

Disposable Sealing Means

The cap (1) of the present invention further comprises a disposable sealing means (4) sealing the outlet opening (5) on the cap body (2).

In a preferred embodiment said disposable sealing means (4) may be welded on at least a portion of the base (13) of the spout (6) to form a resistant sealing means against high pressure build-up particularly due to large impact forces. Preferably the material of said disposable sealing means (4) is selected from polyethylene therephthalate (PET), polyurethane, aluminum foil, polypropylene and mixtures thereof. Suitable films of this type typically comprise PET 12 μm/Adhesive 5 μm/ink (optional)/soft aluminium foil 38 μm/coextruded welding layer 116 μm.

In another embodiment the disposable sealing means (4) may comprise a pull tab (30) for easy removal of said disposable sealing means (4). A pull tab (30) is particularly advantageous when the cap body (2) comprises a spout (6), in order improve peeling. Preferably, said pull tab (30) is dimensioned to provide easy reach for the user whilst not compromising the opening and closing of the cap (1). More preferably said pull tab (30) is capable of folding into the gap formed between the flange (19) on the cap body (2) and the portion of the inner surface (9) of the outer wall (7) of said cap body (2), its insertion aided by the ridge (20) on the lid (3) of said cap (1) upon closing. When folded in, a portion of said pull tab is easily accessible for the user to grip in order to begin the peeling action.

In a preferred embodiment said pull tab (30) may be located on a side of the cap body (2), preferably proximal to the hinged connection with the lid (3). This configuration allows for ease of pealing, particularly when the top (12) of the spout (6) is slanted at an angle.

In another embodiment the disposable sealing means (4) may have a peel force of between 7N and 15N, preferably between 7N and 11N, and more preferably between 9N and 11N. As used herein peel force refers to the force required to peel the disposable sealing means (4). If the force is below the abovementioned ranges the user will have not the intended quality impression while forces greater than the abovementioned ranges would be undesirable due to the greater fatigue placed on users and the greater likelihood of tearing and incomplete peeling.

In another embodiment the disposable sealing means (4) may have a bursting pressure of at least 2.5 bar, preferably between 2.5 bar and 4 bar. As used herein bursting pressure refers to the pressure needed to cause failure (or bursting) of the disposable sealing means (4). It has been found that a disposable sealing means (4) having a bursting pressure within the above-mentioned ranges provides for a leak-proof sealing also at high impact forces.

Table A illustrates the peel force and burst pressures of a number of materials.

TABLE A

| Test | Material | Settings | Results |
|---|---|---|---|
| 1 | Film 1: PET 12 μm/Adhesive 5 μm/ink (optional)/soft aluminum foil 38 μm/coextruded welding layer 116 μm. | P: 80 N/cm$^2$ T: 230° C. | Peel force: 10.9 N Burst pressure: NA |
| 2 | Film 1: PET 12 μm/Adhesive 5 μm/ink (optional)/soft aluminum foil 38 μm/coextruded welding layer 116 μm. | P: 80 N/cm$^2$ T: 240° C. | Peel force: 12.4 N Burst pressure: 3.2 bar |
| 3 | Film 2: PET 12 μm/Adhesive 5 μm/aluminum foil 38 μm/coextruded welding layer 10 μm. | P: 80 N/cm$^2$ T: 240° C. | Peel force: 12.1 N Burst pressure: 3.6 bar |
| 4 | Film 3: PET 50 μm/primer/coextruded welding layer 33 μm | P: 80 N/cm$^2$ T: 250° C. | Peel force: no seal Burst pressure: |
| 5 | Film 3: PET 50 μm/primer/coextruded welding layer 33 μm | P: 300 N/cm$^2$ T: 250° C. | Peel force: no seal Burst pressure: |
| 6 | Film 3: PET 50 μm/primer/coextruded welding layer 33 μm | P: 300 N/cm$^2$ T: 210° C. | Peel force: no seal Burst pressure: 0.8 bar |
| 7 | Film 4: PET 23 μm/adhesive/laminated welding layer 35 μm | P: 80 N/cm$^2$ T: 240° C. | Peel force: not possible to peel Burst pressure: NA |
| 8 | Film 4: PET 23 μm/adhesive/laminated welding layer 35 μm | P: 80 N/cm$^2$ T: 210° C. | Peel force: too difficult to peel Burst pressure: |
| 9 | Film 4: PET 23 μm/adhesive/laminated welding layer 35 μm | P: 80 N/cm$^2$ T: 170° C. | Peel force: no seal Burst pressure: NA |
| 10 | Film 4: PET 23 μm/adhesive/laminated welding layer 35 μm | P: 80 N/cm$^2$ T: 185° C. | Peel force: too difficult to peel (damaged foil) Burst pressure: |
| 11 | Film 4: PET 23 μm/adhesive/laminated welding layer 35 μm | P: 80 N/cm$^2$ T: 180° C. | Peel force: 4.8 N Burst pressure: 3.0 bar |
| 12 | Film 1: PET 12 μm/Adhesive 5 μm/ink (optional)/soft aluminum foil 38 μm/coextruded welding layer 116 μm. | P: 80 N/cm$^2$ T: 230° C. | Peel force: 11.0 N Burst pressure: NA |
| 13 | Film 2: PET 12 μm/Adhesive 5 μm/aluminum foil 38 μm/coextruded welding layer 10 μm. | P: 80 N/cm$^2$ T: 230° C. | Peel force: 9.5 N Burst pressure: NA |
| 14 | Film 1: PET 12 μm/Adhesive 5 μm/ink (optional)/soft aluminum foil 38 μm/coectruded welding layer 116 μm.. | P: 80 N/cm$^2$ T: 250° C. | Peel force: too much heat-tab broken Burst pressure: |
| 15 | Film 2: PET 12 μm/Adhesive 5 μm/aluminum foil 38 μm/coextruded welding layer 10 μm. | P: 80 N/cm$^2$ T: 250° C. | Peel force: too much heat-tab broken Burst pressure: |
| 16 | Film 1: PET 12 μm/Adhesive 5 μm/ink (optional)/soft aluminum foil 38 μm/coextruded welding layer 116 μm. | P: 80 N/cm$^2$ T: 210° C. | Peel force: 10.2 N Burst pressure: 4 bar |
| 17 | Film 2: PET 12 μm/Adhesive 5 μm/aluminum foil 38 μm/coextruded welding layer 10 μm. | P: 80 N/cm$^2$ T: 210° C. | Peel force: 7.4 N Burst pressure: 4 bar |

Locking Means

The cap (1) of the present invention comprises a locking means disposed on the cap body (2) and the lid (3) to lock said lid (3) onto said cap body (2).

Referring to FIG. 6, the locking means may comprise a panel (25) connected to a lid (3) of the cap (1) at the perimeter thereof, preferably connected to a portion of the first lid surface (22), at least one protrusion (26) extending from a portion of said panel (25) towards the inside of said lid (3) for coupling with a slot (27) provided in a portion of the cap body (2) of said cap (1), and an elastically deformable material (28) connecting said panel (25) to said lid (3). Preferably, said elastically deformable material (28) is selected from the group consisting of a thermoplastic elastomer (TPE), silicone and mixtures thereof.

The panel (25) may comprise a bottom, two sides, and a top, when viewed from the front of the cap (1) in its closed position. Preferably said bottom is not straight and experiences a curve while the top and the two sides are straight such that the perimeter of said panel (25) forms an arch-type shape. It is however understood that other shapes may equally be suitable such as square, circular, rectangular and so on.

In a preferred embodiment, at least one portion of the panel (25) may abut at least a portion of a first surface of contact (10) of the cap body (2) when pressure is applied to said panel (25). The first surface of contact (10) may be curved to aid sliding between at least a portion of the panel (25) and said first surface of contact (10). Preferably, said at least one portion of said panel (25) comprises at least one projection (29) extending along at least a part of the height of said panel (25). Preferably, said projection (29) extends for at least 50% of said height. The height of the panel (25) is defined herein as the vertical distance from the bottom of the panel (25) to the top of the panel (25) taken along a plane substantially parallel to the longitudinal axis (YY), preferably said height extends substantially parallel to the two side edges of said panel (25). The projection (29) may further comprise a gradient to improve the sliding ability over said first surface of contact (10), thus easing the opening of the lid (3). Such projections (29) may provide stiffening of the panel (25) concurrently with improving the sliding ability of the panel (25) over said first surface of contact (10).

In another preferred embodiment at least a portion of the protrusion (26) may extend at an angle c, wherein said angle is between 1 and 2 degrees. In this embodiment also at least a potion of the slot (27) is slanted at an angle b so that coupling with said protrusion (26) is achieved when the lid (3) is pressed onto the cap body (2), wherein said angle is between 0 and 2 degrees. This configuration allows for stronger interlocking of the two parts allowing for a greater resistance to opening unless the locking means is disengaged by applying pressure onto the panel (25) with one or more fingers.

In one embodiment the protrusion (26) may extend from 0.80 mm to 0.85 mm towards the inside of the lid (3) and the slot (27) is from 0.86 mm to 0.9 mm deep. By "inside of the lid" it is meant herein that the protrusion (26) extends from an inner face of the first lid surface (22) for a predetermined length in a direction substantially perpendicular to the longitudinal axis (YY) to approach the ridge (20) formed on said lid (3). The term "deep or depth" as used herein refers to the dimension taken from a plane substantially perpendicular to the longitudinal axis (YY) from the open end to the closed end of the slot (27).

In a preferred embodiment the length of the protrusion (26) may be shorter than the length of the slot (27). The term "length" as used herein means the distance between one end to the other end of either said protrusion (26) or said slot (27) taken along a plane substantially perpendicular to the longitudinal axis (YY). The advantage of this configuration is that location of the protrusion (26) into the slot (27) during closing of the lid (3) is simplified.

In a preferred embodiment the panel (25) may rotate about an axis perpendicular to the longitudinal axis (YY) when pressure is applied thereto so that disengagement of the protrusion (26) from the slot (27) and abutting of the at least one portion of the panel (25) onto the first surface of contact (10) of the cap body (2) occurs substantially simultaneously. In this embodiment, when a radial pressure is applied by the user the panel (25) rotates and the protrusion (26) exits the slot (27), concurrently a portion of the panel (25) abuts a portion of the first surface of contact (10) to cause sliding between the faces thereof. At this point the protrusion (26) is in a different axial position with respect to the slot (27) such that the radial pressure may be released without the protrusion (26) re-engaging with said slot (27). A milder upward pressure can then be applied to lift the lid (3) completely. One advantage of such configuration is that the force required by the user to unlock the cap (1) is reduced thanks to the combination of both lever effect and sliding motion. Another advantage is that unlocking of the cap (1) may be achieved by applying a pressure solely in the radial direction of the cap (1). The user can then easily lift the lid (3) by applying an upward pressure on the lid (3). The upward pressure needed is considerably lower than the initial pressure in the radial direction required for unlocking of the lid (3) from the cap body (2) making the entire opening process of the cap (1) easier for the user. The locking means herein in turn allows to construct a protrusion (26) and slot (27) capable of generating a greater interlocking force without compromising ease of opening.

In one embodiment the locking means may be capable of withstanding a push through force of between 30N and 70N, preferably between 50N and 70N, when said locking means is engaged. By push through force as used hereinbefore, it is meant the force required to open the cap (1) without disengaging the locking means, applied in a direction substantially parallel to the longitudinal axis (YY) onto the inner top face of the lid (3). Said force is applied from the inside out. It has been found that a locking means capable of withstanding the abovementioned forces, allows the cap (1) to remain closed particularly against pressure build ups resulting from impact forces particularly during accidental knock-over in everyday use.

In a further embodiment the locking means may be disengaged by applying a force of between 15N and 35N onto a portion of said panel (25). By disengagement of the locking means as used hereinbefore, it is meant: the concurrent release of the protrusion (26) from the slot (27) along with abutting and initial sliding of a portion of said panel (25) onto the first surface of contact (10) of said cap body (2). Such forces have been found suitable for single handed opening of the cap (1), without significantly impacting the force that such locking means is capable of resisting when locked. A lubricating additive may be added to the resin of the cap body (2), lid (3) and locking means where the greatest contact occurs. Preferably, said lubricating additive is selected from the group consisting of erucamide, siloxane and mixtures thereof.

In one embodiment, at least a portion of the panel (25) may be further connected to the lid (3) by a second material having a lower elastic deformation than the elastically deformable material (28), preferably said second material is the same material of said lid (3). In this embodiment, the panel (25) may be connected to the lid (3) by said second material at two discrete locations, one on each of the two sides of the panel (25) parallel and mirrored to each other such to form two parallel pivot points for rotation. The remaining portions of the panel may be connected to the lid (3) via the elastically deformable material (28). Preferably, the two discrete locations are proximal to the bottom of the panel (25) and distal from the top of the panel (25) such that a greater rotational arm is formed between the two parallel pivot points and said top of the panel (25).

In a preferred embodiment the elastically deformable material (28) covers at least one face of said panel (25), preferably the face onto which the user applies pressure thereon, more preferably the face pointing away from the inside of said lid (3). The advantage of this configuration is that grip is improved allowing the user to apply the necessary pressure for unlocking without the risk of one or more fingers slipping, thus making singlehanded opening easier. A further advantage is that the elastically deformable material (28) aids the protrusion (26) to snap into the slot (27) by applying an additional tension, preferably said tension exerts a resultant force in a direction substantially perpendicular to the longitudinal axis (YY).

In a further embodiment said elastically deformable material (28) may comprise indicia on at least part of its surface, preferably the surface onto which the user applies pressure thereon with one or more fingers. Preferably, said indicia may indicate the optimal position onto which the user should press to achieve unlocking with the least possible effort.

Method of Use

Figure 8A:
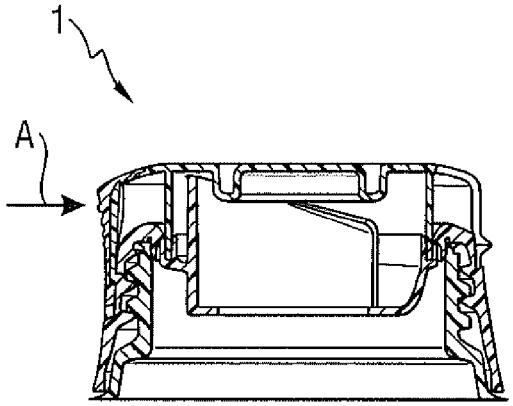
FIG. 8A to C are side cross-section views of the cap according to one embodiment of the present invention illustrating the opening of said cap.
Figure 8B:
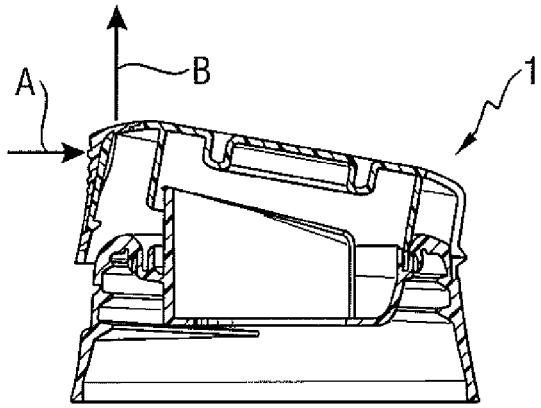
Figure 8C:
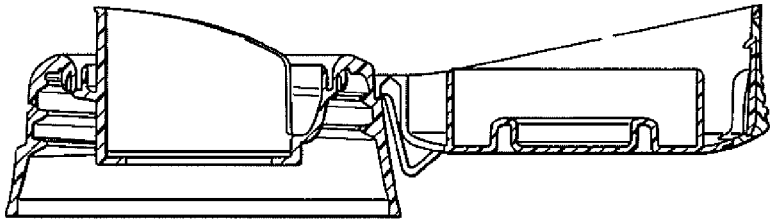
Figure 9:
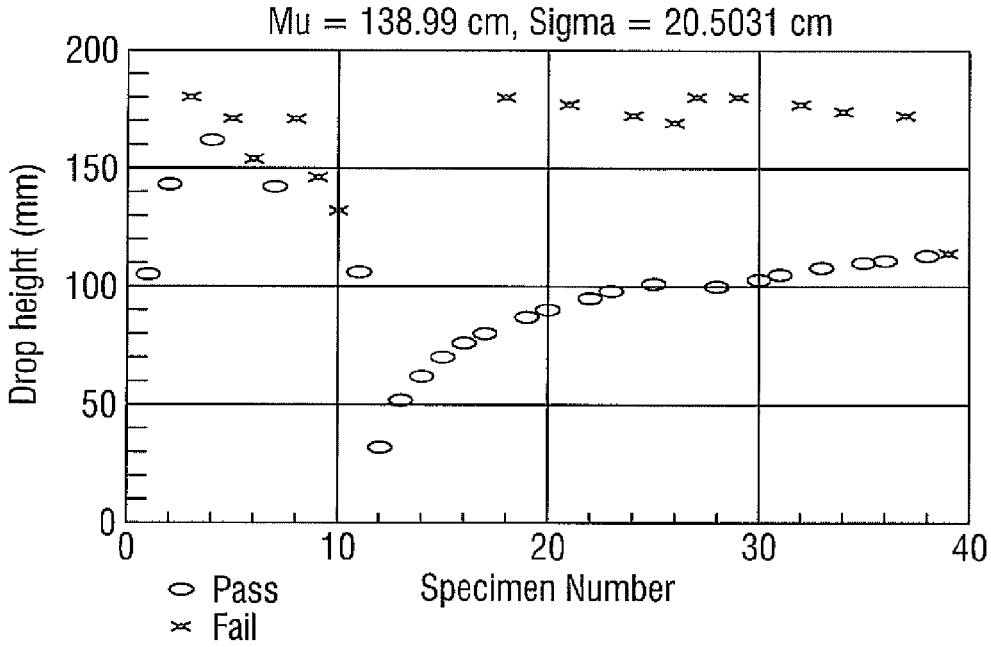
FIG. 9 is a graph illustrating the drop test for caps according to embodiments of the present invention connected to containers of 3 liters. These results indicate that caps of the present invention remain closed and sealed at an average drop height of 139 cm.

FIG. 8A-C illustrate an example of the operation of the cap (1). FIG. 8A illustrates the resting position of the cap (1) in its closed position, prior to use. The user disengages the lid (3) by applying a pressure, preferably in the radial direction, onto at least a portion of the panel (25) forming part of the locking means with one or more fingers. The direction and location of the pressure is indicated in FIG. 8A by the arrow A. This pressure causes the panel (25) to rotate upon an axis perpendicular to the longitudinal axis (YY) such that the protrusion (26) exits the slot (27) substantially concurrently with a portion of said panel (25) abutting at least a portion of a first surface of contact (10) of the cap body (2). At the same time said portion of the panel (25) begins to slide over the first surface of contact (10) to ease the disengagement of the protrusion (26) from the slot (27). FIG. 8B illustrates the disengagement of the protrusion (26) from the slot (27). The user may now apply a substantially upward pressure to lift the lid (3) to its fully open position for pouring of the content of the container connected thereto. Alternatively, the user may continue to apply a radial pressure, albeit of smaller magnitude, onto said portion of the panel (25) combined with an upward pressure to lift the lid (3) thus creating a smooth transition between the disengagement of the protrusion (26) from the slot (27) and the lifting of the lid. FIG. 8B illustrates both the radial pressure of smaller magnitude A' and the upward pressure B. By the term "smaller magnitude" as used herein it is meant that the magnitude of the radial pressure applied when the protrusion (26) and slot (27) have disengaged is less than the radial pressure applied before said disengagement. FIG. 8C illustrates the cap (1) in its fully open position. Once the user has finished pouring the content, the lid (3) may be closed singlehandedly by pushing said lid (3) back onto the cap body (2) until the protrusion (26) snaps back into the slot (27) to lock the cap (1) in its closed position. The operation may be repeated for subsequent uses.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A cap comprising:

(i) a cap body capable of being connected to a container, said cap body comprising an outlet opening therein;

(ii) a lid for coupling with said cap body;

(iii) a disposable sealing means sealing said outlet opening; and (iv) a locking means disposed on said cap body and said lid to lock said lid onto said cap body;

wherein said locking means comprises:

(i) a panel connected to said lid on at least a portion of a perimeter thereof, wherein at least one portion of said panel abuts at least a portion of a first surface of contact of said cap body when pressure is applied onto said panel and when said lid is in its closed position or when said lid is partly in contact with said cap body;

(ii) at least one protrusion extending from a portion of said panel towards the inside of said lid for coupling with a slot provided in a portion of said perimeter of said cap body; and (iii) an elastically deformable material connecting said panel to said lid;

wherein said panel rotates about an axis perpendicular to a longitudinal axis when pressure is applied thereto so that disengagement of said protrusion from said slot and abutting of said at least one portion of said panel onto said first surface of contact is achieved substantially simultaneously.

2. A cap according to claim 1 wherein said cap body comprises a spout and wherein said outlet opening is located therein.

3. A cap according to claim 1 wherein said at least one portion of said panel comprises at least one projection extending along at least a part of a height of said panel, and said projection comprises a gradient to improve sliding over said first surface of contact.

4. A cap according to claim 1 wherein said lid is hingedly connected to said cap body.

5. A cap according to claim 1 wherein said cap body is capable of being connected to a container with a torque of between about 100 Ncm and about 600 Ncm, and wherein said cap body experiences an upwardly deflection of not more than about 0.3 mm.

6. A cap according to claim 1 wherein said disposable sealing means comprises a pull tab for easy removal, said pull tab dimensioned to provide easy reach for the user whilst not compromising opening and closing of said cap.

7. A cap according to claim 1 wherein said disposable sealing means is peeled with a peel force of between about 7N and about 15N.

8. A cap according claim 1 wherein said disposable sealing means has a bursting pressure of at least about 3 bar.

9. A cap according to claim 2 wherein said cap body comprises a flange extending substantially parallel and proximal to said spout, and wherein said lid comprises a ridge extending within and substantially parallel to a first lid surface defining the perimeter of said lid, wherein said ridge inserts between said flange and a portion of the inner surface of the outer wall of said cap body when said lid is closed to provide a second sealing means.

10. A cap according to claim 1 wherein said cap body comprises:

(i) a flat notch capable of contacting an uppermost surface of a container neck when said cap body is fully screwed onto said container neck;

(ii) a plug seal proximal said flat notch extending substantially parallel a longitudinal axis of said cap, and capable of contacting at least a portion of an inner surface of said container neck;

wherein said flat notch and plug seal provide a sealing means when said cap body is screwed with a torque of between about 100 Ncm and about 600 Ncm to said container neck.

11. A method of single-handedly opening a cap, according to claim 1, comprising the steps of applying pressure onto a portion of said locking means with one or more fingers and concurrently lifting said lid.

* * * * *